US006125549A

United States Patent [19]

Pikus

[11] Patent Number: 6,125,549

[45] Date of Patent: Oct. 3, 2000

[54] RADIANT HEATER SYSTEM FOR THERMALLY PROCESSING FLOWABLE MATERIALS

[75] Inventor: Ilya Pikus, Plymouth, Minn.

[73] Assignee: Hosokawa Bepex Corporation, Minneapolis, Minn.

[21] Appl. No.: 09/249,724

[22] Filed: Feb. 12, 1999

[51] Int. Cl.[7] ..... F26B 3/34

[52] U.S. Cl. ..... 34/267; 34/135; 34/182

[58] Field of Search ..... 34/108, 129, 132, 34/130, 135, 179–183, 168, 266, 267, 332, 342, 344, 345, 95; 432/138, 141, 103

[56] References Cited

U.S. PATENT DOCUMENTS

| | | | |
|---|---|---|---|
| 3,662,474 | 5/1972 | Huthwaite | 34/9 |
| 3,859,734 | 1/1975 | Wahlgreen | 34/9 |
| 4,188,185 | 2/1980 | Suh et al. | 432/27 |
| 4,530,166 | 7/1985 | Miller | 34/39 |
| 4,746,404 | 5/1988 | Laakso | 162/232 |
| 4,770,236 | 9/1988 | Kulikowski | 165/86 |
| 4,791,735 | 12/1988 | Forberg | 34/181 |
| 4,826,361 | 5/1989 | Merz | 406/60 |
| 4,888,882 | 12/1989 | Ryham | 34/10 |
| 5,203,794 | 4/1993 | Stratford et al. | 51/410 |
| 5,216,821 | 6/1993 | McCabe et al. | 34/17 |
| 5,271,163 | 12/1993 | Pikus et al. | 34/33 |
| 5,410,984 | 5/1995 | Pikus et al. | 117/206 |
| 5,454,344 | 10/1995 | Pikus et al. | 117/11 |
| 5,497,562 | 3/1996 | Pikus | 34/269 |
| 5,522,156 | 6/1996 | Ware | 34/356 |
| 5,532,335 | 7/1996 | Kimball et al. | 528/495 |
| 5,634,282 | 6/1997 | Pikus | 34/266 |
| 5,711,089 | 1/1998 | Pikus | 34/267 |
| 6,000,144 | 12/1999 | Bussmann et al. | 34/332 |

*Primary Examiner*—Stephen Gravini
*Assistant Examiner*—Andrea M. Joyce
*Attorney, Agent, or Firm*—Piper Marbury Rudnick & Wolfe

[57] ABSTRACT

A system for the thermal processing of material in a housing having an inlet for receipt of the materials and an outlet for the discharge of the material after thermal treatment. The heating of the materials is accomplished, at least in part, by contact of the materials with a particulate medium which has been preheated in a separate heating operation employing infrared radiant heaters. The housing includes a heating zone separate from the zone used for thermal processing of the materials with the separate heating zone including the infrared radiant heaters. The particulate medium is introduced to the heating zone and brought to a controlled temperature. The medium is then conveyed to the processing zone where it is admixed with the materials being thermally processed. A shrouded zone is located intermediate the processing and particulate medium heating zones. This zone comprises a section of reduced clearance thereby providing a gas and dust lock between the processing and heating zones. The conveyor system may comprise a single shaft supporting agitating and conveying paddles in the processing and heating zones and a screw conveyor in the intermediate shrouded zone.

8 Claims, 1 Drawing Sheet

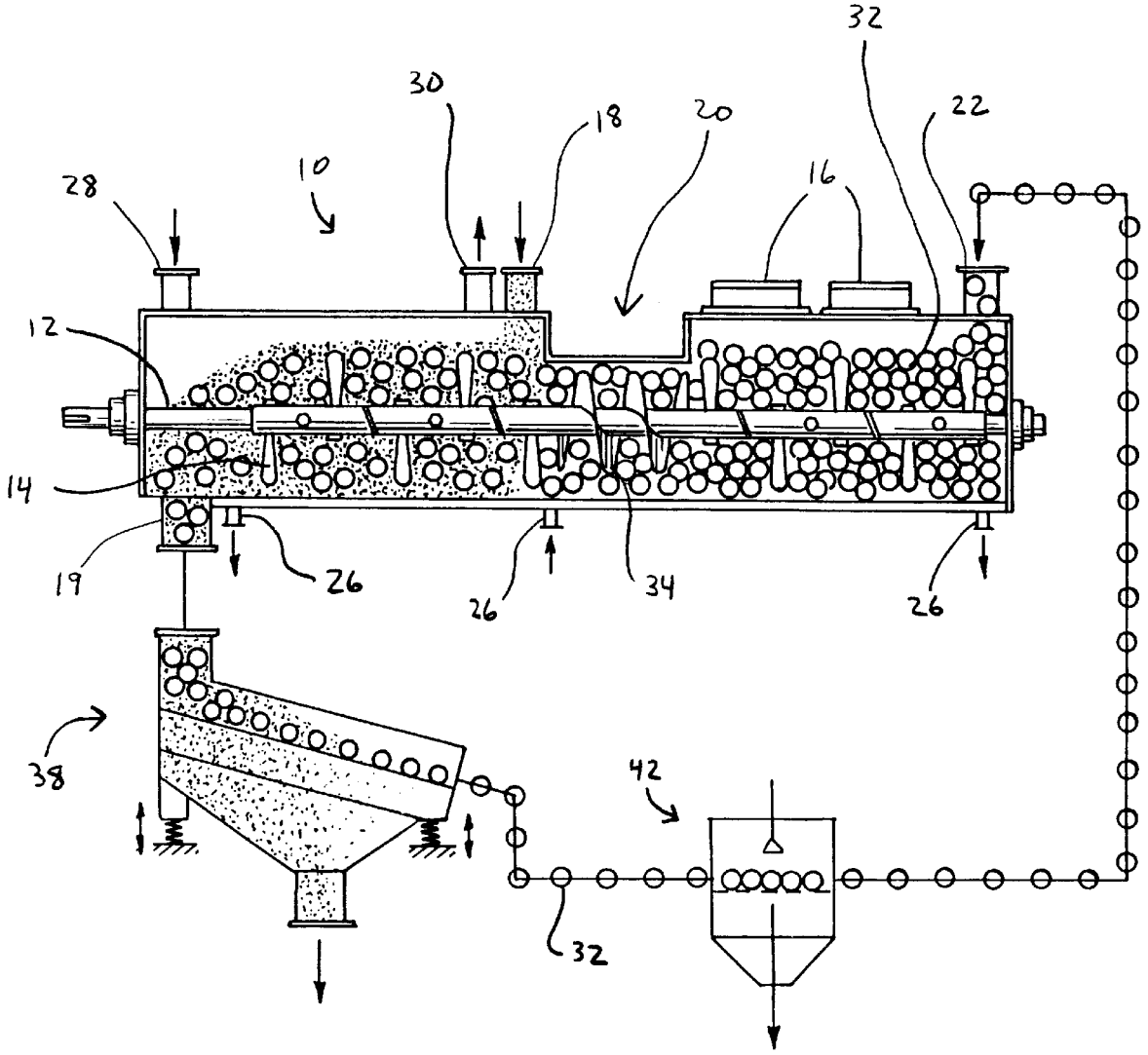
32
30
18
20
22
10
28
16
12
14
19
26
26
34
26
38
42
32

RADIANT HEATER SYSTEM FOR THERMALLY PROCESSING FLOWABLE MATERIALS

BACKGROUND OF THE INVENTION

This invention relates to a method and apparatus for thermally processing flowable materials while utilizing a radiant heater system. The invention relates particularly to a unique system which is well suited for thermally processing powders, pellets, wet filter cakes, slurries and sludges which exhibit poor infrared absorptivity and which cannot be thermally treated efficiently when exposed directly to sources of infrared radiation.

The invention comprises a system which may be implemented utilizing components of an apparatus of the type generally described in U.S. Pat. No. 5,634,282. This apparatus consists of an elongated housing having an axially mounted rotatable shaft disposed therein. A plurality of paddles or vanes are mounted on the rotatable shaft and these extend outwardly from the periphery of the shaft. In accordance with known practices, the paddles are set at an angle whereby rotation of the shaft operates to continuously move material from the inlet end of the unit toward the outlet end. As described in the aforementioned patent, the apparatus is provided with spaced apart infrared radiant heaters which are mounted over the openings in the top wall of the housing. By introducing flowable material at one end of the vessel, treatment of the material is achieved by means of radiant energy of electric or gas operated radiant heaters or by means of electromagnetic waves of the electromagnetic spectrum which produces heat upon being absorbed by the material being processed.

As further described in the aforementioned patent, the radiant heater system has certain distinct advantages over prior art arrangements. By relying primarily on radiant heating rather than on conductive or convective heating, dependence on the intervening medium such as heated air to achieve a desired temperature is avoided. Due to direct heat transfer to the particles by means of radiant energy, the material temperature can be maintained efficiently at an optimal level. The heat transfer rate with infrared radiation is much higher than with convective systems (such as a fluid bed) or with a conductive system (such as jacketed indirect heat supply thermal processors). As illustrated in the patent, with such higher heat transfer rates, more thermoprocessing can be accomplished in less space. The infrared radiant heaters have low thermal mass (inertia) and can, therefore, respond almost instantaneously to modulating controls. Accordingly, the temperature of material being processed can be maintained precisely.

A system of the type contemplated is especially suited for high temperature thermal treatment of flowable materials when other known methods of heat supply, such as one based, for example, on circulation of hot liquid medium through a jacketed processor, are unusable due to their temperature limit. It is recognized that the temperature limit for liquid heating media available in the industry is 700–750° F. while the infrared radiant heaters (for instance, the high density infrared heater of a type manufactured by Research Inc., Model 5208) can heat material being processed up to 2,500° F.

It has, however, also been recognized that available infrared heating processors are inefficient when treating some materials such as fine powders, white or light-colored materials with low radiative absorptivity, and difficult to handle heavy viscous materials (filter cakes, slurries and sludges) which exhibit thixotropic characteristics when subjected to agitation and shear forces. Fine powders, being mechanically fluidized in an agitated processor, tend to generate an airborn aerosol which reduces the heat transfer efficiency of the radiative flux and which can cause an undesirable deposition of dust particles on the emitting surfaces of the radiant heater, resulting in failure of the processor. White and light-colored flowable materials tend to reflect the radiation received (their absorptivity is very low), thereby increasing the required capital equipment cost and operating expenses.

There has been a long-recognized difficulty in utilization of the prior art infrared systems for thermal processing of shear-sensitive viscous materials. When shear force is applied during thermal processing and conveying, these materials, due to their thixotropic characteristics, revert from a free flowing cake or sludge to a heavy, viscous hard-to-handle paste. In drying applications, the viscosity of such material is constantly increasing as water (or solvent) are evaporated, and the infrared processor then gradually becomes less efficient or incapacitated.

It has also been recognized that available infrared heater systems cannot be used for processing some flammable materials (containing, for example, flammable solvents), as well as for treatment of some heat-sensitive organic materials and chemicals which can decompose or change their quality (color, for example) when being exposed to direct infrared radiation.

SUMMARY OF THE INVENTION

This invention provides an improved radiant heater system for thermally processing flowable materials by utilization of an intermediate particulate heat transfer medium which is compatible with the material being processed and which possesses a high radiant absorptivity and easy-to-handle characteristics.

In particular, the system of this invention provides for the thermal processing of materials in a housing having an inlet for receipt of the materials and an outlet for the discharge of the material after thermal treatment. The heating of the materials is accomplished, at least in part, by contact of the materials with a particulate medium which has been preheated in a separate heating operation employing infrared radiant heaters.

In a preferred form of the invention, the housing includes a heating zone separate from the zone used for thermal processing of the materials with the separate heating zone including the infrared radiant heaters. The particulate medium is introduced to the heating zone and brought to a carefully controlled temperature. The medium is then conveyed to the processing zone where it is admixed with the materials being thermally processed.

The preferred system also includes a "shrouded" zone located intermediate the thermal processing and particulate medium heating zones. This zone comprises a section of reduced clearance thereby providing a gas and dust lock between the processing and heating zones. The conveyor means used for transporting the particular medium from the heating zone to the thermal processing zone may comprise a single shaft supporting agitating and conveying paddles in the processing and heating zones and a screw conveyor in the intermediate shrouded zone.

The term "particulate medium" is intended to cover any one of a variety of discrete pieces adapted to achieve the thermal processing purposes of the invention. Dark colored balls or beads made of attrition-resistant material comprise the preferred materials since these are available in a free flowable form, with a high degree of looseness, and are easy to handle. Such particles can be provided in a form chemically and technologically compatible with the material being processed and are available with high radiant absorptivity and high heat capacity.

BRIEF DESCRIPTION OF THE DRAWING

The drawing consists of a schematic illustration of the system of this invention.

DESCRIPTION OF THE PREFERRED EMBODIMENTS

The invention comprises a system which may be implemented utilizing components of an apparatus of the type generally described in U.S. Pat. Nos. 5,634,282 and 5,711,089. As shown in the drawing, an apparatus of this type consists of an elongated housing 10 having an axially mounted rotatable shaft 12 disposed therein. A plurality of paddles or vanes 14 are mounted on the rotatable shaft and these extend outwardly form the periphery of the shaft. In accordance with known practices, the paddles are set at an angle whereby rotation of the shaft operates to continuously move material from the inlet end of the unit toward the outlet end. As described in the aforementioned patents, the apparatus is provided with spaced-apart infrared radiant heaters 16 mounted over openings in the top wall of the housing. By introducing flowable material at one end of the vessel, treatment of the material is achieved b means of radiant energy of electric or gas operated radiant heaters or by means of electromagnetic waves of the electromagnetic spectrum which produces heat upon being absorbed by the material being processed.

The particular housing 10 shown in the drawing consists of a processing zone at the left hand side including, an inlet 18 for introduction of materials to be thermally processed. An intermediate shrouded zone 20 separates the processing zone from a particulate medium heating zone. This latter zone includes an inlet 22 for introduction of the medium. The pair of radiant heaters 16 are positioned over openings in housing 1 in this heating zone whereby medium introduced to this zone will be exposed to the radiant energy.

The housing 10 is jacketed to permit circulation of hot liquid or steam through fittings 26 and between the inner and outer walls of the housing. In addition, gas inlet 28 and gas outlet 30 are provided so that hot gases can be circulated through the interior of the housing processing zone.

In operation, particulate medium, for example in the form of beads 32, is introduced through inlet 22 and exposed to radiant energy for heating of the medium to a desired temperature. Rotation of shaft 12 with paddles 14 results in uniform heating of the discrete beads while at the same time conveying the beads toward the end of this heating zone.

The shrouded zone 20 is a confined area which, as illustrated, will restrict the passage of gases and dust out of the heating zone. The shaft 12 preferably supports a screw conveyor 34 in this shrouded zone which will most effectively convey the medium while at the same time enhancing the gas and dust lock function of the zone.

Material introduced through inlet 18 will encounter the medium entering from the shrouded zone for admixture therewith particularly in view of the agitating function of the paddles 14. This mixing takes place while the paddles are also serving to convey the mixture toward outlet 19 of the housing.

The radiant heater system has certain distinct advantages over prior art arrangements when thermal processing in accordance with this invention. By relying primarily on the heat transfer achieved with the particulate medium, and on the heating thereof by radiant heating, rather than on conductive or convective heating, dependence on an intervening medium such as heated air to achieve a desired temperature is avoided. Due to direct heat transfer to the particulate medium by means of radiant energy, the material temperature can be maintained efficiently at an optimal level. The heat transfer rate with the infrared radiation and particulate medium combination of the invention is much higher than with convective systems (such as a fluid bed) or a conductive system (such as jacketed indirect heat supply thermal processors). With such higher heat transfer rates, more thermoprocessing can be accomplished in less space. The infrared radiant heaters have low thermal mass (inertia) and can, therefore, respond almost instantaneously to modulating controls. Accordingly the temperature of the particulate medium and consequently of the material being processed can be maintained precisely.

A system of the type contemplated is especially suited for high temperature thermal treatment of flowable materials when other known methods of heat supply based, for example, on circulation of heating liquid medium through a jacketed processor, are unusable due to their temperature limit. It is recognized that the temperature limit for liquid heating media available in the industry is 700–750° F. while the infrared radiant heaters (for instance, the high density infrared heater of a type manufactured by Research Inc., Model 5208) can heat the particulate medium and the material being processed up to 2,500° F.

The intermediate particulate heat transfer medium utilized in the practice of the invention should meet the following requirements:

1) medium should have free flowability, high looseness and be easy-to-handle.
2) medium should be chemically and technologically compatible with the material being processed in the system; and,
3) medium should be made of material with high radiant absorptivity (preferably, dark-colored material) and high heat capacity.

The individual particles of the intermediate particulate heat transfer medium should have regular (preferably spherical) shape with a smooth surface in order to provide a better system handling performance and an efficient separation of the material being processed from the medium particles downstream of the processor. Dark colored balls or beads made of attrition-resistant materials such as flintstone, aluminum-oxide, steatite, hard porcelain, metals or glass can be used for this application. Food-graded polymer beads (made for example from teflon or polyster) can be utilized as the medium for processing some edible products such as eggs, fruit and vegetable pastes, dairy and soy products, ground meat and fish paste.

Where spherical, a diameter of from 1/16" up to ½" is preferred. These figures are applicable to other shapes in the sense of maximum and minimum dimensions. For example, the length and diameter of cylindrically shaped pellets would preferably be in the order of ¼".

In the heating zone of the system equipped with spaced-apart infrared radiant heaters, the action of the rotating agitator continually exposes the surface area of the heat transfer medium particles to the radiant energy emitted by the radiant heater(s) for efficient absorption of heat energy at a high rate. As noted, the paddles are set at an angle whereby rotation of the agitator operates to continually move the medium from the inlet end of the zone to the outlet end and then further into the transitional shrouded zone 20.

The illustrated arrangement for the zone 20 provides the features of a tubular screw auger with a reduced clearance between the housing wall and agitator in order to obtain the desired dust and/or gas lock between the medium heating zone and the material processing zone.

In the material processing zone which consists of an elongated preferably U-shaped (or tubular) section of the housing, the agitating action results in intimate contact between the flowable material being introduced into the processing zone with preheated particles of the intermediate heat transfer medium, and the material thereby absorbs heat energy by means of conductive heat transfer. Due to a relatively high heat transfer surface area between the flowable material being processed and the particulate heat transfer medium, and owing to a vigorous interaction of these particles in the rapidly mixed and mechanically fluidized agitated bed, a rapid and efficient thermal processing of different materials in general (and particularly, difficult-to-handle heavy viscous paste-like products) can be provided in the processor.

Processing conditions will vary, of course, depending on the material to be heated. Generally, however, the heat flow from the infrared preheated intermediate heat transfer medium to the material being processed, as well as the heating kinetics and the processing temperature of this material in the processor, depends upon the following factors:

1) the temperature of the preheated medium which is introduced into the material processing zone;
2) the heat and material balance characteristics of the heat transfer medium and material being processed, including the flow rates ratio, specific heats, water equivalents, etc.; and,
3) the heat and mass transfer properties and variables for the agitated bed of particular diameters, intensity of agitation, drying or reaction rate, viscosity of material being processed, etc.

In the thermal processing system of the invention, the heat flux to the material being processed can be easily controlled by changing the mass flow rates ratio of the heat exchanging streams. This provides certain distinct advantages over prior art arrangements. Thus, since the temperature of the intermediate heat transfer medium in the infrared heating zone can be maintained precisely, and inasmuch as the material being processed is not exposed directly to the high temperature heat emitters but instead absorbs heat energy by a conductive heat transfer with the medium, the resultant temperature of a heat-sensitive product in the processor can be maintained efficiently at an optimal level.

With the system of this invention, the process temperature control can be provided by adjusting the intermediate heat transfer medium temperature and/or its flow rate through the processor. The latter can be achieved by adjusting the re-circulation rate of the medium through the system and the rotational speed of the conveying agitator can be controlled accordingly. Temperature control in the infrared preheating zone is discussed in the aforementioned U.S. Pat. No. 5,634,282.

Product recovery (or separation of the product being processed from the re-circulated medium) can be provided by means of mechanical or aerodynamical separators such as oscillating sieve/screen separators, air separators, etc. as shown at 38. Therefore the particle size of the intermediate heat transfer medium has to be larger than the processed product particles. Provided the separators and the medium handing system are well insulated, the intermediate heat transfer medium can be recycled back into the infrared heating zone at about the same temperature at which the product and the medium are discharged from the processor, thereby improving the overall thermal efficiency of the processing system proposed. An additional cleaning device 42, for instance of a water-spray-screen-belt-conveyor type, can be provided for a thorough separation of the medium particles from any trace of the product fines remaining after the upstream separation step.

As noted, the housing 10 of the thermal processor may be provided with jacketed sidewalls and liquid heat transfer medium or steam may be introduced to the jacketed wall to enhance heat transfer to the material being processed. Also as shown, a gas inlet and outlet are provided for the processing zone and these may be equipped with a means for purging of hot gas through the housing. This hot gas can be used as a supplementary heat source to control and maintain the material temperature at the optimum level. The rapid exposure of the material particles achieved by the rotating agitator and vigorous interaction between material and the particulate medium in the processing zone, improves the convective heat and mass transfer. This combination of preheated intermediate particulate heat transfer medium and hot gas as heat sources for thermal processors can provide improved and efficient thermal processing and drying for difficult-to-dry and difficult to handle materials.

Of particular interest is the application of the processor for thermally processing and/or drying viscous, paste-like material. Such kinds of material, when coming in contact with an agitated bed of the particulate medium, will coat the hot surface of the solid particles in a form of a thin layer of film. The relatively high conductive heat transfer rate between the particulate medium hot surface and material provides rapid heating of the material and enhances the diffusion of the liquid molecules across the film to its surface. The temperature of the thin layer of material will remain constant (at the liquid's wet bulb temperature) as moisture evaporates. This evaporative effect enables the efficient and rapid drying of heat sensitive materials such as, for example, paste-like food products.

It will be understood that various changes and modifications may be made in the system of the invention without departing from the spirit of the invention particularly as described in the following claims.

What is claimed:

1. An apparatus for thermally processing material comprising a housing having a processing zone, an inlet at one end of the processing zone for receipt of said material and an outlet at the opposite end of the processing zone for discharge of the material, a separate entry defined by the processing zone, a particulate medium, infrared radiant heaters for heating said medium to a processing temperature, means for introducing the heated medium into said processing zone through said separate entry for admixture of the medium with said material, a rotary conveyor for moving the medium and material in the processing zone toward said outlet, said housing including a heating zone provided with said infrared heaters, and a shrouded zone located between said processing zone and said heating zone, said rotary conveyor extending into said shrouded zone and said heating zone, means for introducing said medium to said heating zone for heating said medium to said processing temperature, said rotary conveyor providing means for moving the heated medium into said processing zone, the dimensions of said housing in said shrouded zone substantially corresponding to the diameter of said rotary conveyor whereby a dust and gas lock is formed between the processing zone and the heating zone, and means for removing the medium and material from said outlet.

2. An apparatus according to claim 1 wherein said particulate medium consists of beads each having at least one minimum dimension of about 1/16 inch.

3. An apparatus according to claim 2 wherein said beads have a maximum thickness dimension of about ½ inch.

4. An apparatus according to claim 3 wherein said beads are of spherical shape and have a diameter up to about ½ inch.

5. An apparatus according to claim 1 including means for separating the medium from the material after removal from said outlet and for recycling said medium for reheating to said processing temperature.

6. An apparatus according to claim 1 wherein said housing is provided with spaced-apart inner and outer surrounding walls, and means for introducing heated fluid between said inner and outer walls to heat said admixture of material and medium.

7. An apparatus according to claim 1 wherein said housing is provided with gas inlet and outlet means, and means for introducing hot gas through said gas inlet for adding heat to the admixture of material and medium.

8. An apparatus according to claim 1 wherein said rotary conveyor comprises a single shaft extending throughout said housing, a first section of said shaft located in said heating zone of said housing, spaced-apart paddles supported on said first section for agitating said medium and conveying said medium toward said shrouded zone, a second section of said shaft located in said shrouded zone, a screw conveyor supported on said second section, a third section of said shaft located in said processing zone, and spaced-apart paddles supported on said third section for agitating the admixture of medium and material and conveying the admixture to said outlet.

* * * * *